US010470592B1

(12) United States Patent
Walker

(10) Patent No.: US 10,470,592 B1
(45) Date of Patent: Nov. 12, 2019

(54) THIGH HIGH BOOT RACK

(71) Applicant: Vickie Walker, Ypsilanti, MI (US)

(72) Inventor: Vickie Walker, Ypsilanti, MI (US)

( * ) Notice: Subject to any disclaimer, the term of this patent is extended or adjusted under 35 U.S.C. 154(b) by 0 days.

(21) Appl. No.: 16/195,975

(22) Filed: Nov. 20, 2018

(51) Int. Cl.

| | |
|---|---|
| ***A47F 7/08*** | (2006.01) |
| ***A47B 61/04*** | (2006.01) |
| ***A47F 5/08*** | (2006.01) |
| ***A47G 25/00*** | (2006.01) |
| *A47F 5/00* | (2006.01) |

(52) U.S. Cl.
CPC ..... *A47F 7/08* (2013.01); *A47B 61/04* (2013.01); *A47F 5/0884* (2013.01); *A47G 25/005* (2013.01); *A47F 5/0006* (2013.01)

(58) Field of Classification Search
CPC ... A47B 61/04; A47F 7/08; A47F 7/24; A47F 5/13; A47F 5/10; A47F 5/137; A47F 5/01; A47F 5/0006; A47F 7/163; A47F 7/19; A47F 7/06; A47F 7/12; A47F 5/0884; A47G 25/0664; A47G 25/0685; A47G 25/005; A47G 25/74; A47G 25/743; A47G 25/746; Y10T 24/3431; Y10T 24/3433; Y10T 24/3435; Y10T 24/3443; A47L 23/20
USPC ..... 280/47.35, 47.19, 79.2, 79.3; 211/34–38, 211/124
See application file for complete search history.

(56) References Cited

U.S. PATENT DOCUMENTS 1,568,330 A * 1/1926 Harding ..... A47L 23/20 211/35
1,626,399 A * 4/1927 Fischer ..... A47F 7/08 211/35
2,246,081 A * 6/1941 Van Nattan ..... A47F 7/12 211/118
2,483,303 A * 9/1949 Rysick ..... A47G 25/485 223/96
3,806,008 A * 4/1974 De Lettre ..... A47G 25/905 223/111
3,937,485 A * 2/1976 Shourek ..... B62B 3/04 280/35
4,149,290 A * 4/1979 Sansen ..... A47G 25/005 12/114.8
4,953,715 A * 9/1990 Celli ..... A47G 25/005 211/34
D320,898 S 10/1991 Dyess
(Continued)

FOREIGN PATENT DOCUMENTS

KR 20160136161 * 11/2016 ..... A47G 25/02

OTHER PUBLICATIONS

Machine english translation of KR20160136161.*

*Primary Examiner* — Hiwot E Tefera

(57) ABSTRACT

The thigh high boot rack is a rolling rack. The thigh high boot rack is configured for use with a plurality of footwear commonly referred to as thigh high boots. The thigh high boot rack suspends the plurality of footwear above a supporting surface. The thigh high boot rack comprises a pedestal, a plurality of stanchions and a plurality of hyoids. The plurality of stanchions attaches the plurality of hyoids to the pedestal. The plurality of footwear is suspended from the plurality of hyoids. The pedestal is a rolling structure. The pedestal transfers the load of the thigh high boot rack and the stored plurality of footwear to the supporting surface. The plurality of stanchions elevate the plurality of hyoids above the supporting surface.

3 Claims, 4 Drawing Sheets

(56) References Cited

U.S. PATENT DOCUMENTS

| | | | | |
|---|---|---|---|---|
| 5,294,007 | A | 3/1994 | Edmondson | |
| D351,514 | S | 10/1994 | Nodine | |
| 5,655,669 | A | 8/1997 | Moore | |
| 7,578,400 | B1 * | 8/2009 | Hartman, Sr. | A47B 81/00 211/182 |
| 7,775,410 | B2 | 8/2010 | Zamzow | |
| 9,648,949 | B1 * | 5/2017 | Penaflor | A47B 81/00 |
| 2009/0127215 | A1 * | 5/2009 | Gale | A47B 61/04 211/85.3 |
| 2010/0122961 | A1 * | 5/2010 | Moreau | A47G 25/16 211/85.7 |
| 2011/0036794 | A1 * | 2/2011 | Schott | A47G 25/0671 211/85.3 |
| 2014/0097148 | A1 | 4/2014 | Cheng | |
| 2016/0198850 | A1 * | 7/2016 | Wall | A47B 87/0207 211/36 |
| 2016/0324315 | A1 * | 11/2016 | Weaver | A47G 25/0685 |

* cited by examiner

THIGH HIGH BOOT RACK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including furniture, more specifically, a show stand adapted for storing shoes.

SUMMARY OF INVENTION

The thigh high boot rack is a rolling rack. The thigh high boot rack is configured for use with a plurality of footwear commonly referred to as thigh high boots. The thigh high boot rack suspends the plurality of footwear above a supporting surface. The thigh high boot rack comprises a pedestal, a plurality of stanchions and a plurality of hyoids. The plurality of stanchions attaches the plurality of hyoids to the pedestal. The plurality of footwear is suspended from the plurality of hyoids. The pedestal is a rolling structure. The pedestal transfers the load of the thigh high boot rack and the stored plurality of footwear to the supporting surface. The plurality of stanchions elevate the plurality of hyoids above the supporting surface.

These together with additional objects, features and advantages of the thigh high boot rack will be readily apparent to those of ordinary skill in the art upon reading the following detailed description of the presently preferred, but nonetheless illustrative, embodiments when taken in conjunction with the accompanying drawings.

In this respect, before explaining the current embodiments of the thigh high boot rack in detail, it is to be understood that the thigh high boot rack is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the thigh high boot rack.

It is therefore important that the claims be regarded as including such equivalent construction insofar as they do not depart from the spirit and scope of the thigh high boot rack. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
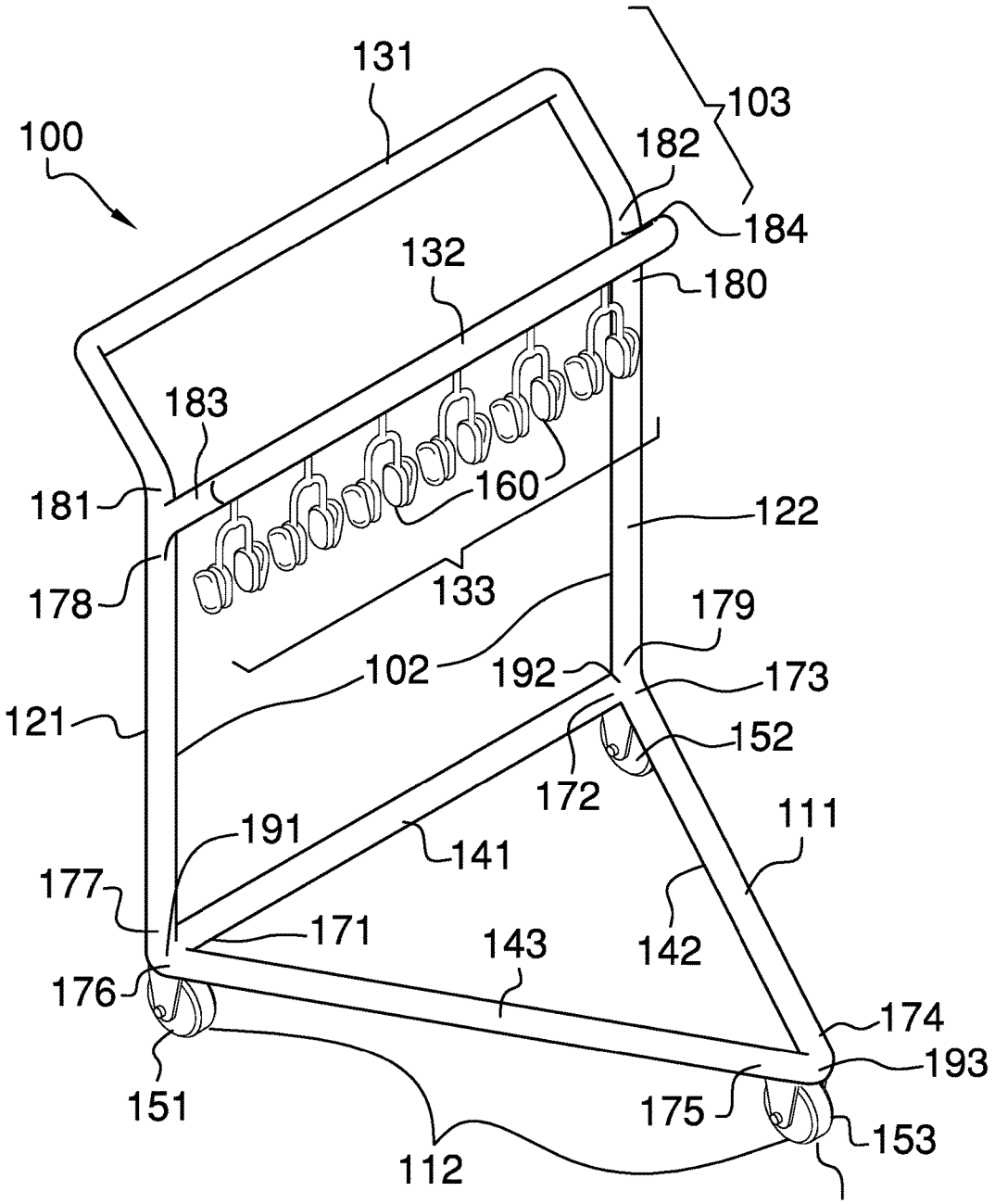
FIG. 1 is a perspective view of an embodiment of the disclosure.
Figure 2:
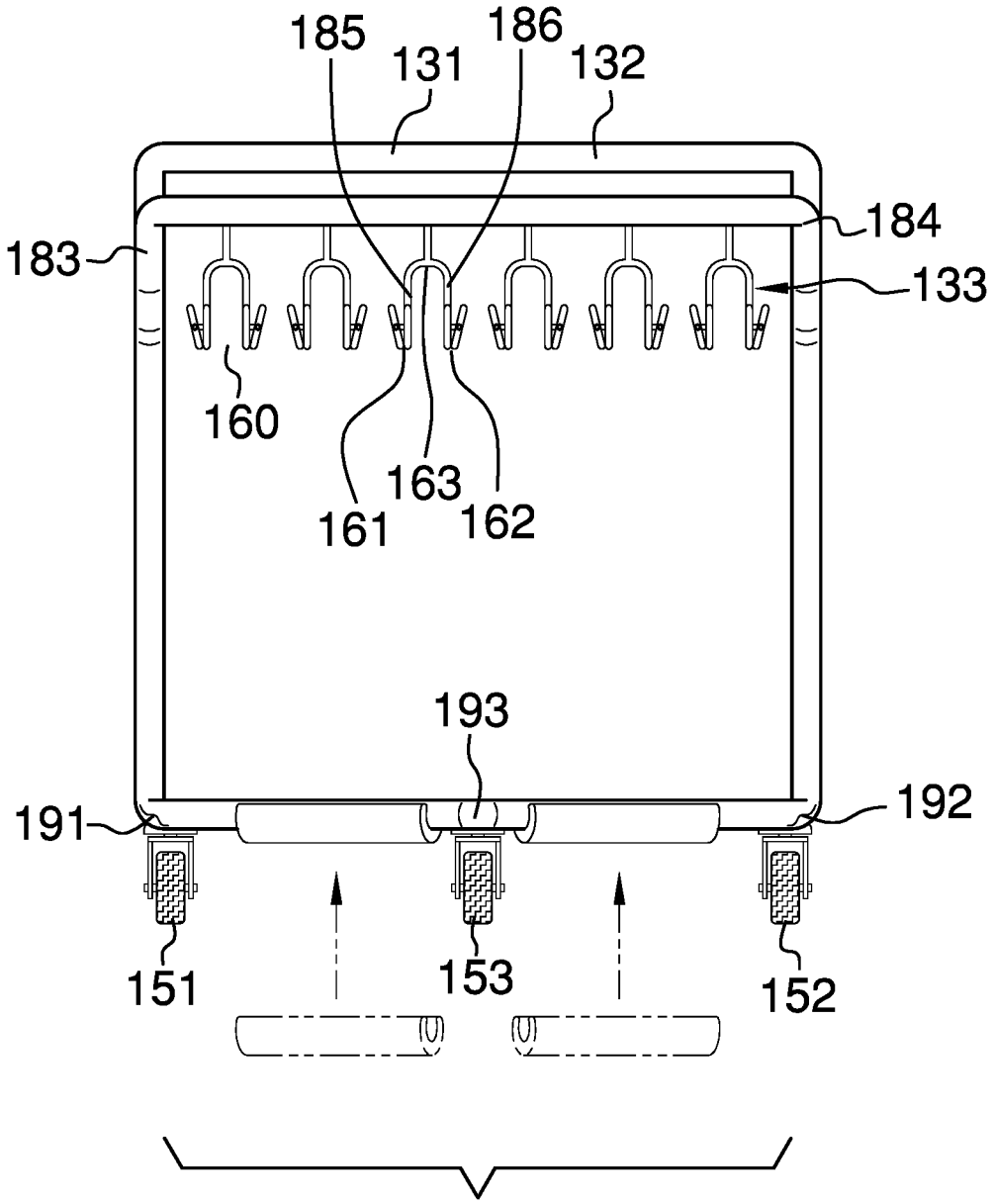
FIG. 2 is a front view of an embodiment of the disclosure.
Figure 3:
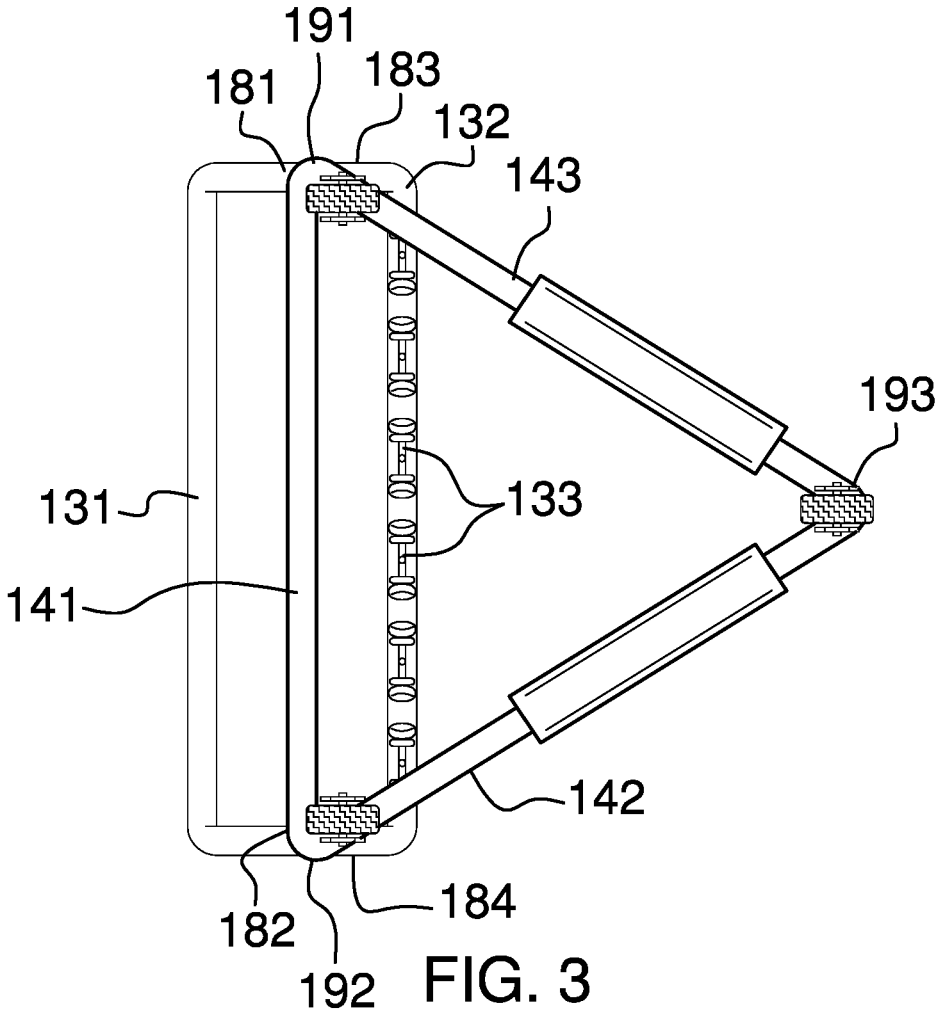
FIG. 3 is a bottom view of an embodiment of the disclosure.
Figure 4:
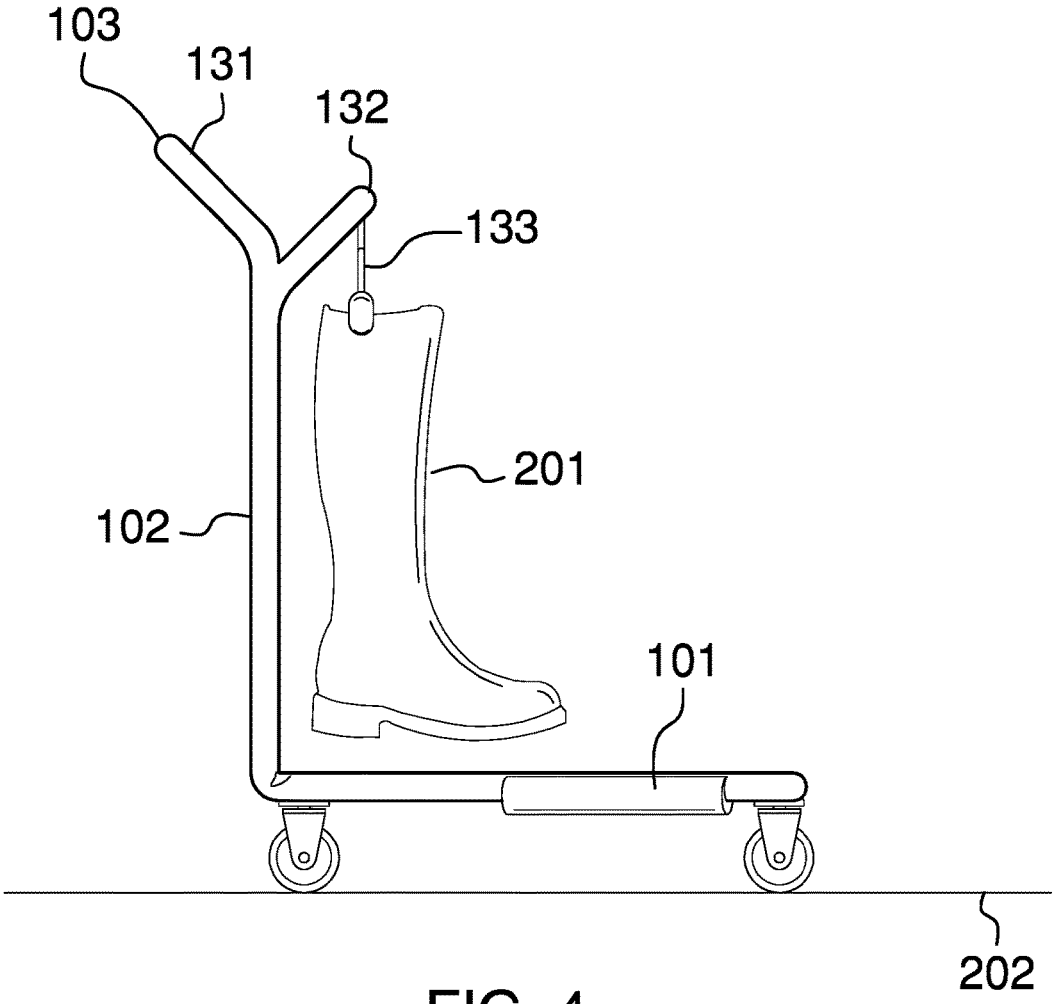
FIG. 4 is an in-use view of an embodiment of the disclosure.

Detailed reference will now be made to one or more potential embodiments of the disclosure, which are illustrated in FIGS. 1 through 4.

The thigh high boot rack 100 (hereinafter invention) is a rolling rack. The invention 100 is configured for use with a plurality of footwear 201 commonly referred to as thigh high boots. The invention 100 suspends the plurality of footwear 201 above a supporting surface 202. The invention 100 comprises a pedestal 101, a plurality of stanchions 102 and a plurality of hyoids 103. The plurality of stanchions 102 attaches the plurality of hyoids 103 to the pedestal 101. The plurality of footwear 201 is suspended from the plurality of hyoids 103. The pedestal 101 is a rolling structure. The pedestal 101 transfers the load of the invention 100 and the stored plurality of footwear 201 to the supporting surface 202. The plurality of stanchions 102 elevate the plurality of hyoids 103 above the supporting surface 202.

The pedestal 101 is a polygon-shaped structure. The pedestal 101 forms the final link of the load path of the invention 100. The pedestal 101 is a rolling structure. The plurality of stanchions 102 and the plurality of hyoids 103 are supported by the pedestal 101. The pedestal 101 is further defined with a first vertex 191, a second vertex 192, and a third vertex 193. The pedestal 101 comprises a base 111 and a plurality of casters 112.

The base 111 is an openwork structure. The base 111 has a polygon shape. In the first potential embodiment of the disclosure, the base 111 has a triangular shape. The base 111 forms a horizontal structure from which each of the plurality of stanchions 102 vertically projects.

The base 111 comprises a first strut 141, a second strut 142, and a third strut 143. The first strut 141 is further defined with a first end 171 and a second end 172. The second strut 142 is further defined with a third end 173 and a fourth end 174. The third strut 143 is further defined with a fifth end 175 and a sixth end 176. The first strut 141 is a prism-shaped shaft. The first strut 141 forms a portion of the perimeter of the polygon shape of the pedestal 101. The second strut 142 is a prism-shaped shaft. The second strut 142 forms a portion of the perimeter of the polygon shape of the pedestal 101. The third strut 143 is a prism-shaped shaft. The third strut 143 forms a portion of the perimeter of the polygon shape of the pedestal 101.

The plurality of casters 112 attach to the vertices of the polygon shape of the base 111. Each of the plurality of casters 112 is a commercially available caster. The plurality of casters 112 allow the pedestal 101 to roll along a supporting surface. Each of the plurality of casters 112 is identical.

The plurality of casters 112 comprises a first caster 151, a second caster 152, and a third caster 153. The first caster 151 is a rolling structure. The first caster 151 attaches to a vertex of the polygon shape of the base 111 such that the pedestal 101 will roll along the supporting surface 202. The second caster 152 is a rolling structure. The second caster 152 attaches to a vertex of the polygon shape of the base 111 such that the pedestal 101 will roll along the supporting surface 202. The third caster 153 is a rolling structure. The third caster 153 attaches to a vertex of the polygon shape of the base 111 such that the pedestal 101 will roll along the supporting surface 202.

Each of the plurality of stanchions 102 is an extension structure. Each of the plurality of stanchions 102 raises the elevation of the plurality of hyoids 103 above the supporting surface 202. The plurality of stanchions 102 comprises a first stanchion 121 and a second stanchion 122. The first stanchion 121 is further defined with a seventh end 177 and an eighth end 178. The second stanchion 122 is further defined with a ninth end 179 and a tenth end 180.

The first stanchion 121 is a prism-shaped shaft. The first stanchion 121 forms a vertically oriented extension structure that raises the plurality of hyoids 103 above the supporting surface 202. The span of the length of the center axis of the first stanchion 121 is selected such that the plurality of footwear 201 are suspended above the pedestal 101 when the plurality of footwear 201 are attached to the plurality of hyoids 103. The second stanchion 122 is a prism-shaped shaft. The second stanchion 122 forms a vertically oriented extension structure that raises the plurality of hyoids 103 above the supporting surface 202. The span of the length of the center axis of the second stanchion 122 is selected such that each of the plurality of footwear 201 are suspended above the pedestal 101 when the plurality of footwear 201 are attached to the plurality of hyoids 103. The first stanchion 121 and the second stanchion 122 are identical.

The plurality of hyoids 103 is a hyoid shaped structure. Each of the plurality of hyoids 103 attaches to a structure selected from the group consisting of the plurality of stanchions 102 and a hyoid selected from the plurality of hyoids 103. Each of the plurality of hyoids 103 performs a function selected from the group consisting of: a) a grip b) suspending a footwear item selected from the plurality of footwear 201; and, c) suspending a hyoid selected from the plurality of hyoids 103. The plurality of hyoids 103 comprises a handle hyoid 131, a suspension hyoid 132, and a plurality of shoe clips 133. The handle hyoid 131 is further defined with an eleventh end 181 and a twelfth end 182. The suspension hyoid 132 is further defined with a thirteenth end 183 and a fourteenth end 184.

The handle hyoid 131 is a hyoid shaped shaft. The handle hyoid 131 forms a grip used to push the invention 100 such that the invention 100 will roll along the supporting surface 202. The handle hyoid 131 attaches to the plurality of stanchions 102 such that the handle hyoid 131 is elevated above the pedestal 101 and the supporting surface 202.

The suspension hyoid 132 is a hyoid shaped shaft. The suspension hyoid 132 forms a horizontal structure from which the plurality of shoe clips 133 are suspended. The plurality of shoe clips 133 attach to the suspension hyoid 132. The suspension hyoid 132 attaches to the plurality of stanchions 102 such that the suspension hyoid 132 is elevated above the pedestal 101 and the supporting surface 202.

Each of the plurality of shoe clips 133 forms an attachment device. Each of the plurality of shoe clips 133 suspends two footwear items selected from the plurality of footwear 201 above the pedestal 101 and the supporting surface 202. Each of the plurality of footwear 201 removably attaches to a shoe clip selected from the plurality of shoe clips 133.

The plurality of shoe clips 133 comprises a collection of individual shoe clips 160. Each individual shoe clip 160 is a fastening device. Each individual shoe clip 160 permanently attaches to the suspension hyoid 132. Each individual shoe clip 160 removably attaches to a first footwear item selected from the plurality of footwear 201. Each individual shoe clip 160 removably attaches to a second footwear item selected from the plurality of footwear 201. Each individual shoe clip 160 stores the first selected footwear item at an elevation above both the pedestal 101 and the supporting surface 202. Each individual shoe clip 160 stores the second selected footwear item at an elevation above both the pedestal 101 and the supporting surface 202. In the first potential embodiment of the disclosure, each individual shoe clip 160 is identical.

Each individual shoe clip 160 further comprises a first clip 161, a second clip 162, and a shoe hyoid 163. Each shoe hyoid 163 is further defined with a fifteenth end 185 and a sixteenth end 186.

The first clip 161 is a spring loaded clip. The first clip 161 attaches to the shoe hyoid 163. The first clip 161 removably attaches to a first footwear item selected from the plurality of footwear 201 such that the first clip 161 suspends the first selected footwear item above the pedestal 101. The second clip 162 is a spring loaded clip. The second clip 162 attaches to the shoe hyoid 163. The second clip 162 removably attaches to a first footwear item selected from the plurality of footwear 201 such that the second clip 162 suspends the first selected footwear item above the pedestal 101. The second clip 162 is identical to the first clip 161. Clips suitable for use as the first clip 161 and the second clip 162 are well-known in the mechanical arts. In the first potential embodiment of the disclosure, the first clip 161 and the second clip 162 are alligator clips.

The shoe hyoid 163 is a hyoid-shaped structure that attaches the first clip 161 and the second clip 162 to the suspension hyoid 132. The shoe hyoid 163 further forms an extension structure that separates the first clip 161 and the second clip 162 such that the first selected footwear and the second selected footwear item do not touch each other during storage.

The following five paragraphs describe the assembly of the invention 100.

The first end 171 of the first strut 141 and the sixth end 176 of the third strut 143 to form the first vertex 191. The second end 172 of the first strut 141 and the third end 173 of the second strut 142 to form the second vertex 192. The fourth end 174 of the second strut 142 and the fifth end 175 of the third strut 143 to form the third vertex 193.

The first caster 151 attaches to the vertex formed by the first end 171 of the first strut 141, the sixth end 176 of the third strut 143, and the seventh end 177 of the first stanchion 121. The second caster 152 attaches to the vertex formed by the second end 172 of the first strut 141, the third end 173 of the second strut 142, and the ninth end 179 of the second stanchion 122. The third caster 153 attaches to the vertex formed by the fourth end 174 of the second strut 142 and the fifth end 175 of the third strut 143.

The first end 171 of the first strut 141 attaches to the seventh end 177 of the first stanchion 121. The sixth end 176 of the third strut 143 attaches to the seventh end 177 of the first stanchion 121. The second end 172 of the first strut 141 attaches to the ninth end 179 of the second stanchion 122. The third end 173 of the second strut 142 attaches to the ninth end 179 of the second stanchion 122. The center axis of the first stanchion 121 is perpendicular to the center axes of the first strut 141 and the third strut 143. The center axis of the second stanchion 122 is perpendicular to the center axes of the first strut 141 and the second strut 142.

The eleventh end 181 of the handle hyoid 131 attaches to the eighth end 178 of the first stanchion 121. The thirteenth end 183 of the suspension hyoid 132 attaches to the eighth end 178 of the first stanchion 121. The twelfth end 182 of the handle hyoid 131 attaches to the tenth end 180 of the second stanchion 122. The fourteenth end 184 of the suspension hyoid 132 attaches to the tenth end 180 of the second stanchion 122.

Each of the plurality of shoe clips 133 attaches to the crossbeam of the suspension hyoid 132. Each individual shoe clip 160 attaches to the crossbeam of the suspension hyoid 132 such that the shoe hyoid 163 hangs below the suspension hyoid 132. The first clip 161 attaches to the fifteenth end 185 of the shoe hyoid 163. The second clip 162 attaches to the sixteenth end 186 of the shoe hyoid 163.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Caster: As used in this disclosure, a caster is a wheel that is mounted on a swivel that allows the wheel to adjust, or swivel, the direction of rotation of the wheel to the direction of motion desired for the wheel.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Clip: As used in this disclosure, a clip is a fastener that attaches to an object by gripping or clasping the object. A clip is typically spring loaded.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. Specifically, the sum of the surface areas of two ends of the prism-shaped object that forms the disk is greater than the surface area of the lateral face of the prism-shaped object that forms the disk. In this disclosure, the ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggests otherwise, the specified horizontal surface is the supporting surface the potential embodiment of the disclosure rests on. The infinitive form of elevation is to elevate.

Extension Structure: As used in this disclosure, an extension structure is an inert physical structure that is used to extend the span of the distance between any two objects.

Footwear: As used in this disclosure, footwear refers to a protective structure that is worn on a foot. Footwear is commonly referred to as a shoe.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hyoid: As used in this disclosure, a hyoid refers to a three-sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of length of the first arm roughly equals the span of length of the second arm. Hyoids generally have a U shaped appearance.

Inferior: As used in this disclosure, the term inferior refers to a directional reference that is parallel to and in the same direction as the force of gravity when an object is positioned or used normally.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with openings that allow for visibility and fluid flow through the structure. Wrought work and meshes are forms of openwork.

Polygon: As used in this disclosure, a polygon refers to a closed planar figure comprising three or more sides. Any two adjacent sides selected from the three or more sides attach to each other such that the two adjacent sides form an interior arc with a cant of less than 180 degrees. A regular polygon is defined as a polygon wherein: a) the span of the length of any side selected from the three or more sides equals the span of the length of any unselected side remaining in the three or more sides; and, b) the arc of the cant between any two adjacent sides selected from the three or more sides equals the arc of the cant of any two unselected sides remaining in the three or more sides. Polygons are often referred to as N-gons where N refers to the number of sides. For example, a pentagon has five sides and a hexagon has six sides.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder Roll: As used in this disclosure, the term roll refers to the motion of an object that is facilitated by the rotation of one or more wheels or casters.

Shaft: As used in this disclosure, a shaft is a long, narrow and rigid prism structure that is used as: 1) a structural element of a larger object; or 2) as a grip or lever for a handle. Shafts often have a cylindrical shape.

Stanchion: As used in this disclosure, a stanchion refers to a vertical pole, post, or support. See beam and gusset and strut.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object. Include inferior superior and load path.

Vertex: As used in this disclosure, a vertex (plural vertices) is an angle that is formed by two lines that form a point. Vertices are commonly found in polygons.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction. Wheels are often further defined with a rim and spokes. Spokes are also commonly referred to as a wheel disk.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A storage rack for boots comprising:

a pedestal, a plurality of stanchions, a plurality of individual shoe clips, and a plurality of arms;

wherein the plurality of stanchions attaches the plurality of arms to the pedestal;

wherein the storage rack for boots is a rolling rack;

wherein the storage rack for boots is configured for use with a plurality of footwear;

wherein the storage rack for boots suspends the plurality of footwear above a supporting surface;

wherein each individual shoe clip of the plurality of individual shoe clips is further comprised of a first clip, a second clip, and a shoe arm;

wherein the first clip attaches to the shoe arm;

wherein the second clip attaches to the shoe arm;

wherein the pedestal is a polygon-shaped structure;

wherein the pedestal is further defined with a first vertex, a second vertex, and a third vertex;

wherein each of the plurality of stanchions is an extension structure;

wherein each of the plurality of stanchions raises the elevation of the plurality of arms above the supporting surface;

wherein the plurality of stanchions and the plurality of arms are supported by the pedestal;

wherein each of the plurality of arms is a U-shaped structure;

wherein the pedestal comprises a base and a plurality of casters;

wherein the plurality of casters attach to the base;

wherein the base is an openwork structure;

wherein the base has a polygon shape;

wherein the base has a triangular shape;

wherein the base forms a horizontal structure from which each of the plurality of stanchions vertically projects;

wherein the plurality of casters attach to the vertices of the polygon shape of the base;

wherein the plurality of casters allow the pedestal to roll along a supporting surface;

wherein each of the plurality of casters is identical;

wherein the plurality of casters comprises a first caster, a second caster, and a third caster;

wherein the first caster is a rolling structure;

wherein the second caster is a rolling structure;

wherein the third caster is a rolling structure;

wherein the first caster attaches to a vertex of the polygon shape of the base such that the pedestal is capable of rolling along the supporting surface;

wherein the second caster attaches to a vertex of the polygon shape of the base such that the pedestal is capable of rolling along the supporting surface;

wherein the third caster attaches to a vertex of the polygon shape of the base such that the pedestal is capable of rolling along the supporting surface;

wherein the plurality of stanchions comprises a first stanchion and a second stanchion;

wherein the first stanchion is a prism-shaped shaft;

wherein the second stanchion is a prism-shaped shaft;

wherein the first stanchion forms a vertically oriented extension structure;

wherein the second stanchion forms a vertically oriented extension structure;

wherein the first stanchion and the second stanchion are identical;

wherein the plurality of arms comprise a handle arm and a suspension arm;

wherein the handle arm attaches to the plurality of stanchions;

wherein the suspension arm attaches to the plurality of stanchions;

wherein the plurality of shoe clips attach to the suspension arm;

wherein the handle arm is a U-shaped shaft;

wherein the suspension arm is a U-shaped shaft;

wherein the handle arm forms a grip;

wherein the suspension arm forms a horizontal structure from which the plurality of shoe clips are suspended;

wherein each of the plurality of shoe clips suspends two footwear items selected from the plurality of footwear above the supporting surface;

wherein each individual shoe clip permanently attaches to the suspension arm;

wherein each individual shoe clip removably attaches to a first footwear item selected from the plurality of footwear;

wherein each individual shoe clip removably attaches to a second footwear item selected from the plurality of footwear;

wherein each individual shoe clip stores the first selected footwear item at an elevation above both the pedestal and the supporting surface;

wherein each individual shoe clip stores the second selected footwear item at an elevation above both the pedestal and the supporting surface;

wherein each individual shoe clip is identical.

2. The storage rack for boots according to claim 1 wherein the first clip is a spring loaded clip;

wherein the second clip is a spring loaded clip;

wherein the first clip removably attaches to the first selected footwear item such that the first clip suspends the first selected footwear item above the pedestal;

wherein the second clip removably attaches to the second selected footwear item such that the second clip suspends the second selected footwear item above the pedestal;

wherein the second clip is identical to the first clip;

wherein the shoe arm is a U-shaped structure that attaches the first clip and the second clip to the suspension arm;

wherein the shoe arm further forms an extension structure that separates the first clip and the second clip such that the first selected footwear item and the second selected footwear item do not touch each other during storage.

3. The storage rack for boots according to claim 1, wherein the first clip and the second clip are alligator clips.

* * * * *